US006944991B2

(12) United States Patent
Kim

(10) Patent No.: US 6,944,991 B2
(45) Date of Patent: Sep. 20, 2005

(54) RAIN GUTTER COVER

(76) Inventor: Hyun T. Kim, 8957 Omega Ct., Springfield, VA (US) 22152

( * ) Notice: Subject to any disclaimer, the term of this patent is extended or adjusted under 35 U.S.C. 154(b) by 0 days.

(21) Appl. No.: 10/745,591

(22) Filed: Dec. 29, 2003

(65) Prior Publication Data

US 2005/0138866 A1 Jun. 30, 2005

(51) Int. Cl.[7] ..... E04D 13/04; E04D 13/064

(52) U.S. Cl. ..... 52/11; 52/12; 52/14; 52/15; 248/48.1; 248/48.2

(58) Field of Search ..... 52/11–16; 248/48.1, 248/48.2

(56) References Cited

U.S. PATENT DOCUMENTS

| | | | | | |
|---|---|---|---|---|---|
| 4,866,890 | A | | 9/1989 | Otto | |
| 5,072,551 | A | * | 12/1991 | Manoogian, Jr. | 52/12 |
| 5,103,601 | A | * | 4/1992 | Hunt | 52/12 |
| 5,109,640 | A | * | 5/1992 | Creson | 52/12 |
| 5,271,192 | A | * | 12/1993 | Nothum et al. | 52/12 |
| 5,406,754 | A | * | 4/1995 | Cosby | 52/12 |
| 5,459,965 | A | | 10/1995 | Meckstroth | |
| 5,535,554 | A | * | 7/1996 | Harris Jr. | 52/12 |
| 5,557,891 | A | * | 9/1996 | Albracht | 52/12 |
| 5,592,783 | A | * | 1/1997 | Jones | 52/12 |
| 5,617,678 | A | * | 4/1997 | Morandin et al. | 52/11 |
| 5,619,825 | A | * | 4/1997 | Leroney et al. | 52/12 |
| 5,640,810 | A | | 6/1997 | Pietersen | |
| 5,660,001 | A | * | 8/1997 | Albracht | 52/12 |
| 5,729,931 | A | * | 3/1998 | Wade | 52/12 |
| 5,813,173 | A | * | 9/1998 | Way, Sr. | 52/12 |
| 5,956,904 | A | * | 9/1999 | Gentry | 52/12 |
| 6,073,398 | A | | 6/2000 | Williams | |
| 6,493,994 | B1 | * | 12/2002 | Lucas | 52/12 |
| 6,598,352 | B2 | * | 7/2003 | Higginbotham | 52/12 |
| 6,672,012 | B2 | * | 1/2004 | Bahroos et al. | 52/11 |
| 6,688,045 | B1 | * | 2/2004 | Pilcher | 52/12 |
| 6,745,516 | B2 | * | 6/2004 | Beyers | 52/12 |

* cited by examiner

*Primary Examiner*—Jeanette E. Chapman
(74) *Attorney, Agent, or Firm*—Birch, Stewart, Kolasch & Birch, LLP

(57) ABSTRACT

A rain gutter cover for covering the gutter, includes a large space screen a curved upper leg portion extended from a roof shingle for engaging with an upper end of the large space screen, and a plurality of supports attached to the curved front leg portion and to a lower leg portion whereby the rain gutter can keep out leaves and other debris, and allow water to enter thereinto and fall down into the gutter effectively and accurately.

8 Claims, 3 Drawing Sheets

RAIN GUTTER COVER

BACKGROUND OF THE INVENTION

1. Field of the Invention

The present invention relates to a rain gutter cover and more particularly, to an improved rain gutter cover having a large space draining net for covering on an upper opening of the rain gutter so as to accurately keep out leaves and other debris on the draining net as well as effectively allowing to enter the flow of water through the draining net.

2. Description of Related Art

Various types of rain gutter covers are known in the art. Generally, a conventional rain gutter cover comprises a plurality of perforations disposed thereon. Therefore, the conventional rain gutters have been subjected to the problem of interference with proper drainage by accumulation of leaves and other debris as long as they have been in use. Various attempts have been made to keep leaves and other debris from accumulating in the rain gutters with only limited success and often with some interference in effective draining of water into the rain gutters, especially in Winter time.

For example, sloping perforated rain gutter covers are disclosed in U.S. Pat. Nos. 4,866,890; 5,459,965; 5,640,810; 5,813,173; and 6,073,398. All of these rain gutter covers extend at a downward inclination over the top of the rain gutters for preventing leaves and other debris from entering into the rain gutter. However, these rain gutter covers do not effectively prevent some accumulation of leaves and other debris on the cover blocking the passage of water into the rain gutter and thereby interfering with the purpose of the rain gutter itself. Particularly in Winter season, since ice on the gutter covers blocks the plurality of perforations of the gutter covers, leaves and other debris accumulate easily and ice melted water cannot fall down into the rain gutter through the gutter covers.

SUMMARY OF THE INVENTION

Accordingly, it is an object of the present invention to provide an improved rain gutter cover which eliminates the above problems encountered with conventional rain gutter covers.

Another object of the present invention is to provide an improved rain gutter cover including a large space draining screen for keeping out leaves and other debris effectively and entering water into the rain gutter accurately through the draining screen even though the season is Winter.

A further object of the present invention is to provide a rain gutter cover including a first, second and third draining net composite unit for easily keeping out leaves and other debris and accurately enter water and rain into the gutter, and both side sealed walls of the rain gutter through the nets, for preventing birds, squirrels, or mice from entering the inside of the house, and from damaging the roof shingle.

Still another object of the present invention is to provide a rain gutter cover which is simple in structure, inexpensive to manufacture, durable in use, and refined in appearance.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
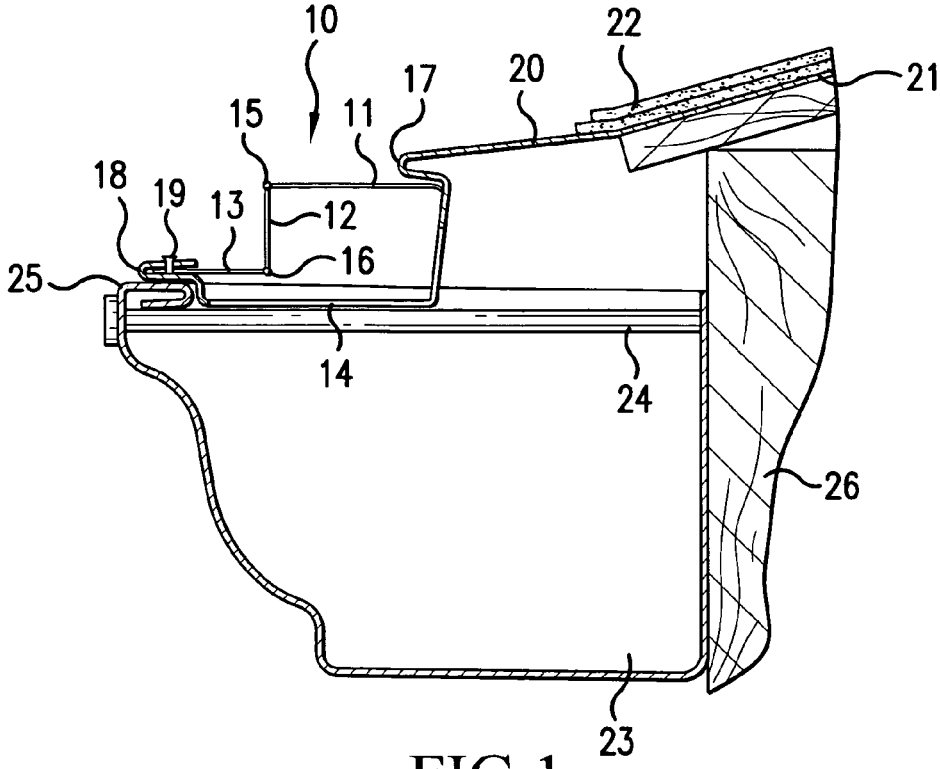
FIG. 1 is a sectional view of a rain gutter cover according to the present invention.
Figure 2:
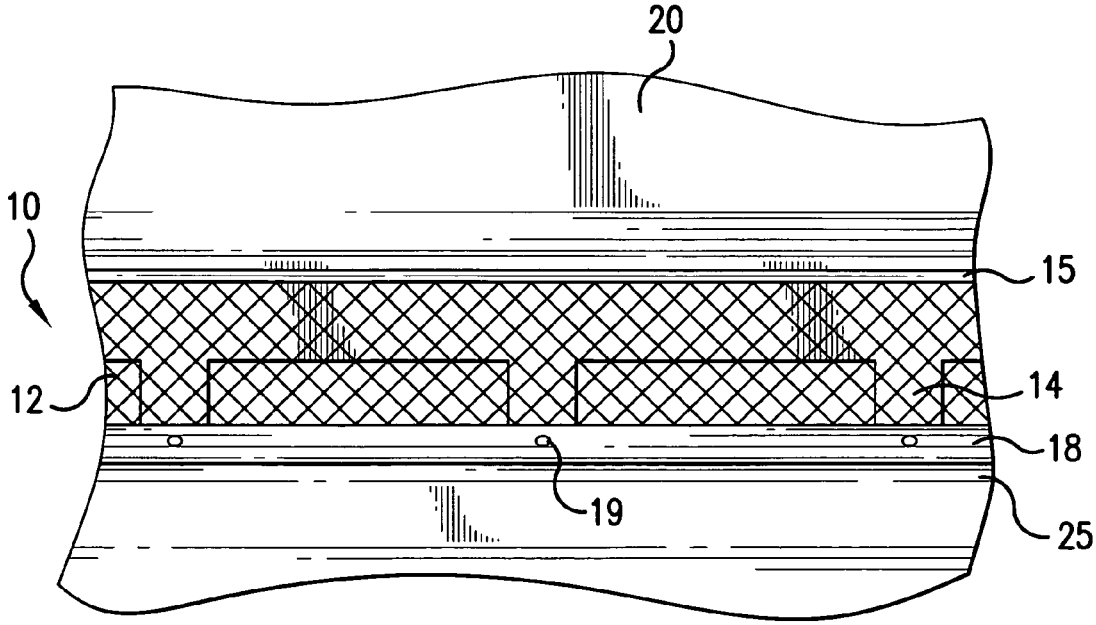
FIG. 2 is a front elevational view of FIG. 1.
Figure 3:
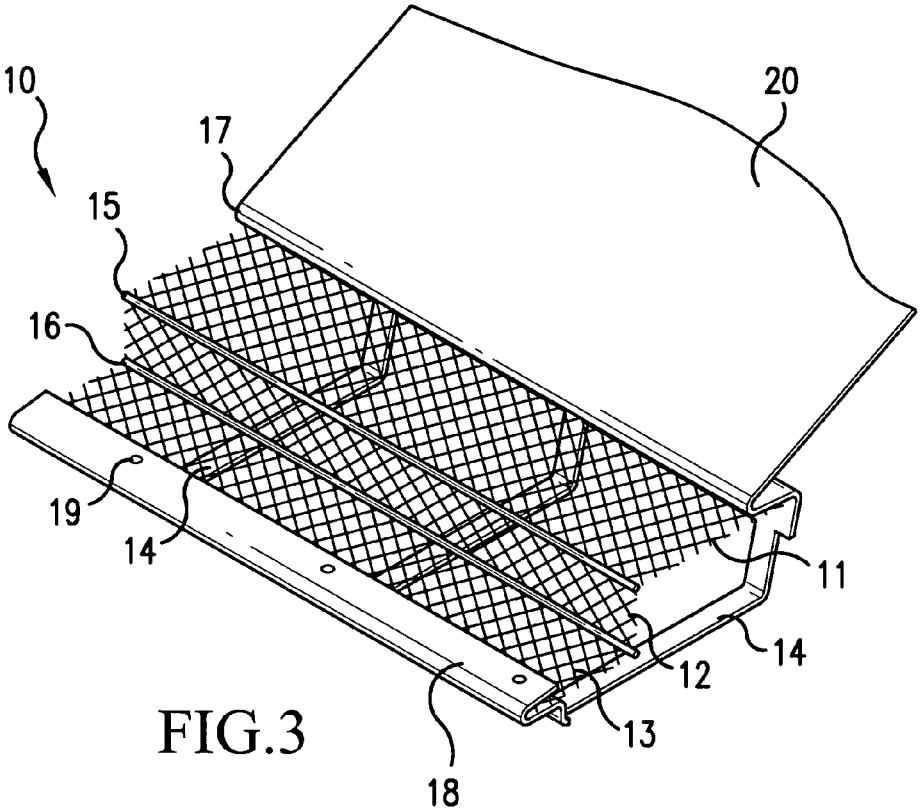
FIG. 3 is a perspective view of FIG. 1.

Referring now in detail to the drawings for the purpose of illustrating preferred embodiments of the present invention, the rain gutter cover 10 as shown in FIGS. 1, 2 and 3, includes a plurality of sequential, laterally first, second and third draining nets 11, 12 and 13, a pair of first and second supports 15 and 16 for connecting to the first and second draining nets 11 and 12, and the second and third draining nets 12 and 13, respectively, and a plurality of supports 14 disposed in the vicinity of a gutter crosspiece 24 of a gutter 23 for supporting the draining nets 11, 12 and 13. The pair of first and second corner supports 15 and 16 are both disposed in parallel within the draining nets 11, 12 and 13. Since the first, second and third draining nets 11, 12 and 13 become a large space screen to be entered therethrough, most water from the roof shingle 22 can enter into the gutter 23 even though leaves remain on the nets.

An upper end of the first draining net 11 is attached to a curved upper leg portion 17 extended from a back planar areas 20 which is extended from an inner edge portion 21 disposed under a roof shingle 22. A lower leg portion 18 is attached to the plurality of supports 14, and attached to a lower end of the third draining net 13 through a plurality of screws 19. The lower leg portion 18 is disposed on a gutter bent leg portion 25 of the gutter 23. The gutter 23 is attached to a building structure 26. The curved upper leg portion 17 can keep out leaves and other debris, but allows capillary flow of water thereover, through the first, second and third draining nets 11, 12 and 13, and into the rain gutter 23.

Figure 4:
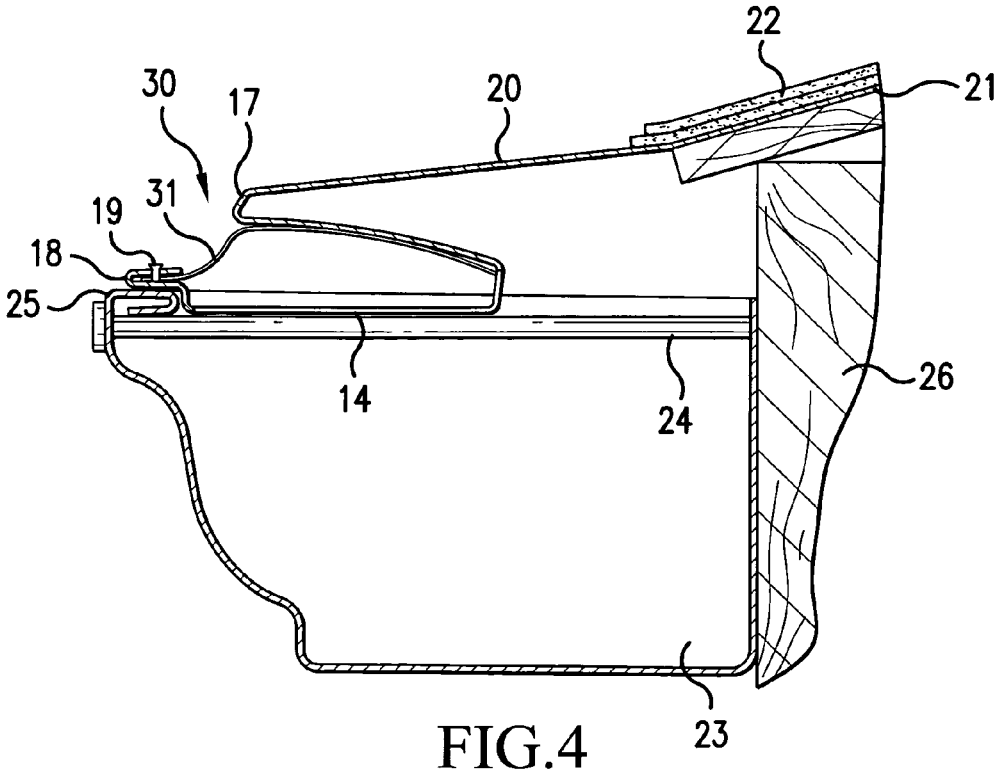
FIG. 4 is a sectional view of a second embodiment of a rain gutter cover according to the present invention.
Figure 5:
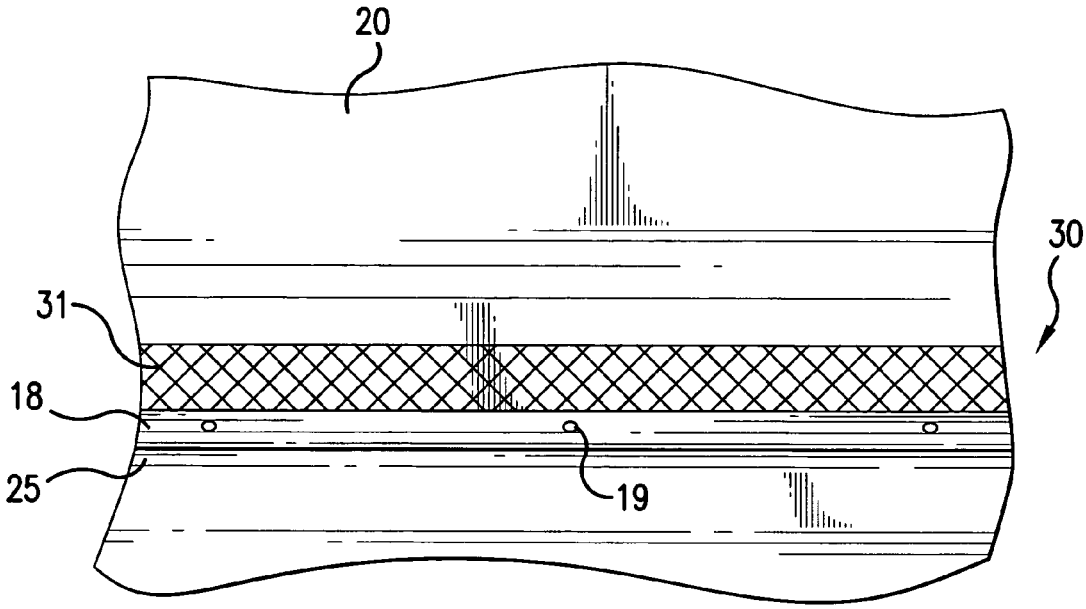
FIG. 5 is a front elevational view of FIG. 4.
Figure 6:
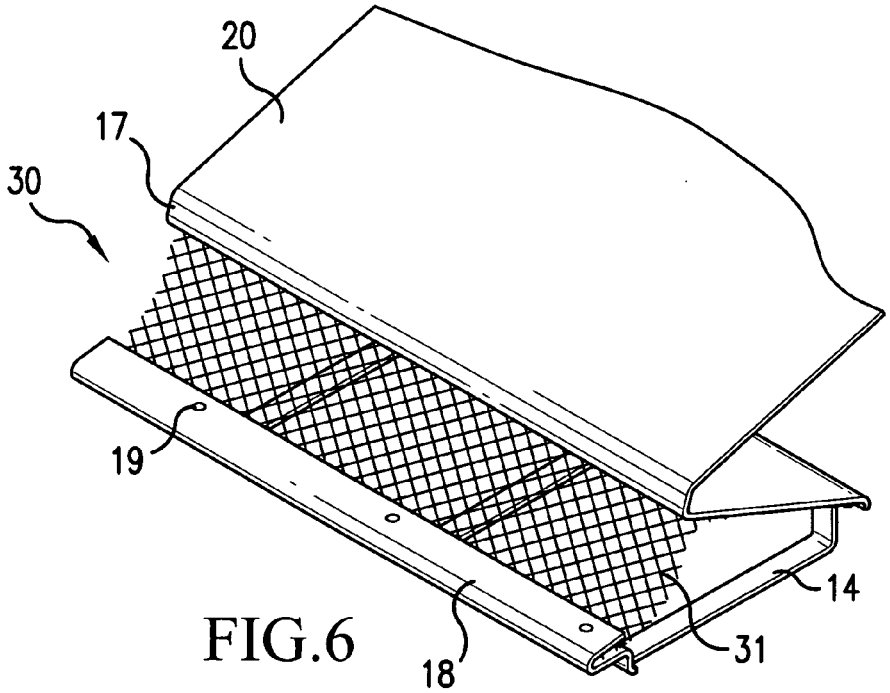
FIG. 6 is a perspective view of FIG. 4.

Referring in detail to FIGS. 4, 5, and 6, there is illustrated a second embodiment of the rain gutter cover 30 in accordance with the present invention. The rain gutter cover 30 includes an arc-shaped draining net 31, the plurality of support 14 disposed in the vicinity of a gutter crosspiece 24 of the rain gutter 23 for supporting the arc-shaped draining net 31. The other elements of the rain gutter cover 30 are the same as the elements 17, 18, 19, 20, 21, 22, 25 and 26 of the rain gutter cover 10. The curved upper leg portion 17 can keep out leaves and other debris, but allows capillary flow of water thereover, through the arc-shaped draining net 31, and into the rain gutter 23. Also, since the draining net 31 is the arc-shaped configuration, the draining net 31 can keep out leaves and other debris, but allows to enter capillary flow of water therethrough, and into the rain gutter 23.

As shown in FIGS. 3 and 6, the draining net 11, 12, 13 and 31 have a large space screen. Because in the first embodiment of the present invention, there is the flat first net 11, the perpendicular second net 12, and the flat third net 13, and in the second embodiment of the present invention, there is the convex arc-shaped net 31. Therefore, the nets according to the present invention, cannot be blocked by leaves and other debris for allowing to enter water therethrough, and to enter into the rain gutter 23. Also, the nets according to the present invention, compose a plurality of large holes, so that does not cover with ice on that in the Winter, and easily enter water thereinto. The nets 11, 12 and 13, according to the present invention, are supported on the first and second corner supports 15 and 16, are sealed with gutter walls (not shown) of the rain gutter 23 can prevent birds, squirrels, or mice from entering into the inside of the building structure 26, and from damaging the roof shingle 22.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rain gutter cover which comprises:

a large space screen for covering a rain gutter;

a curved upper leg portion extended from a back planar area of a roof shingle for engaging with an upper end of the large space screen;

a lower leg portion; and a plurality of supports attached to the curved upper leg portion at one end, and attached to the lower leg portion at other end of the supports, whereby the rain gutter cover can keep out leaves and other debris and allow water to enter from the roof shingle thereinto and fall down into the gutter effectively and accurately; wherein the large space screen includes a first draining net, a second draining net and a third draining net, and a pair of first and second corner supports disposed between the first and second draining nets, and the second and third draining nets, respectively.

2. The rain gutter cover of claim 1, wherein the first draining net has a flat configuration, the second draining net has a perpendicular orientation relative to the first draining net, and the third draining net has a flat configuration.

3. The rain gutter cover of claim 1, wherein the pair of first and second corner supports are both disposed in parallel within the top of the gutter.

4. The rain gutter cover of claim 1, wherein the large space screen is an arc-shaped configuration.

5. The rain gutter cover of claim 4, wherein the arc-shaped configurated net has a convex configuration.

6. The rain gutter cover of claim 1, wherein the lower leg portion is provided with a plurality of screws for tightly attaching the plurality of supports to the lower leg portion.

7. The rain gutter cover of claim 1, wherein the first draining net has a flat configuration, the second draining net has a substantially flat configuration and a substantially perpendicular orientation relative to the first draining net, and the third draining net has a substantially flat configuration and a substantially parallel orientation relative to the first draining net.

8. The rain gutter of claim 1, wherein the curved upper leg portion and the plurality of supports attached to the curved upper leg portion at one end, and attached to a lower leg portion at other end thereof are integrally connected to form a single piece.

* * * * *